US006047044A

United States Patent [19]

Lehmann et al.

[11] Patent Number: 6,047,044

[45] Date of Patent: Apr. 4, 2000

[54] STRAY RADIATION GRID

[75] Inventors: Volker Lehmann, Munich; Dieter Schmettow, Erlangen, both of Germany

[73] Assignee: Siemens Aktiengesellschaft, Munich, Germany

[21] Appl. No.: 09/111,462

[22] Filed: Jul. 7, 1998

[30] Foreign Application Priority Data

Jul. 10, 1997 [DE] Germany ..... 197 29 596

[51] Int. Cl.[7] ..... G21K 1/00

[52] U.S. Cl. ..... 378/154; 378/145

[58] Field of Search ..... 378/154, 155

[56] References Cited

U.S. PATENT DOCUMENTS 5,418,833 5/1995 Logan ..... 378/154

FOREIGN PATENT DOCUMENTS 0 731 472 11/1996 European Pat. Off. .

*Primary Examiner*—Craig E. Church

*Attorney, Agent, or Firm*—Hill & Simpson

[57] ABSTRACT

A stray radiation grid for penetrating radiation is produced by starting with a carrier material and producing holes in a first surface thereof, and subsequently filling the holes with penetrating radiation absorbing material. A second, opposite surface of the carrier block is etched away to reduce the thickness of the carrier block, leaving a carrier which is flexible and bendable, from which the radiation absorbing material projects as a number of free-standing absorption elements.

54 Claims, 4 Drawing Sheets

FIG. 4
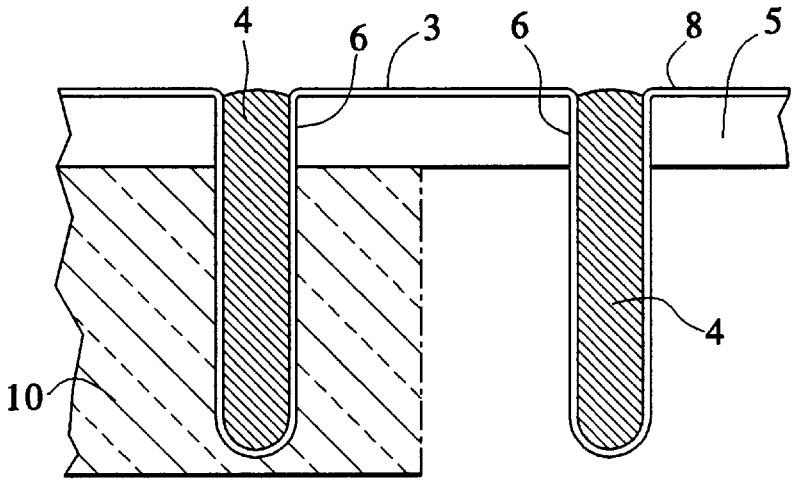
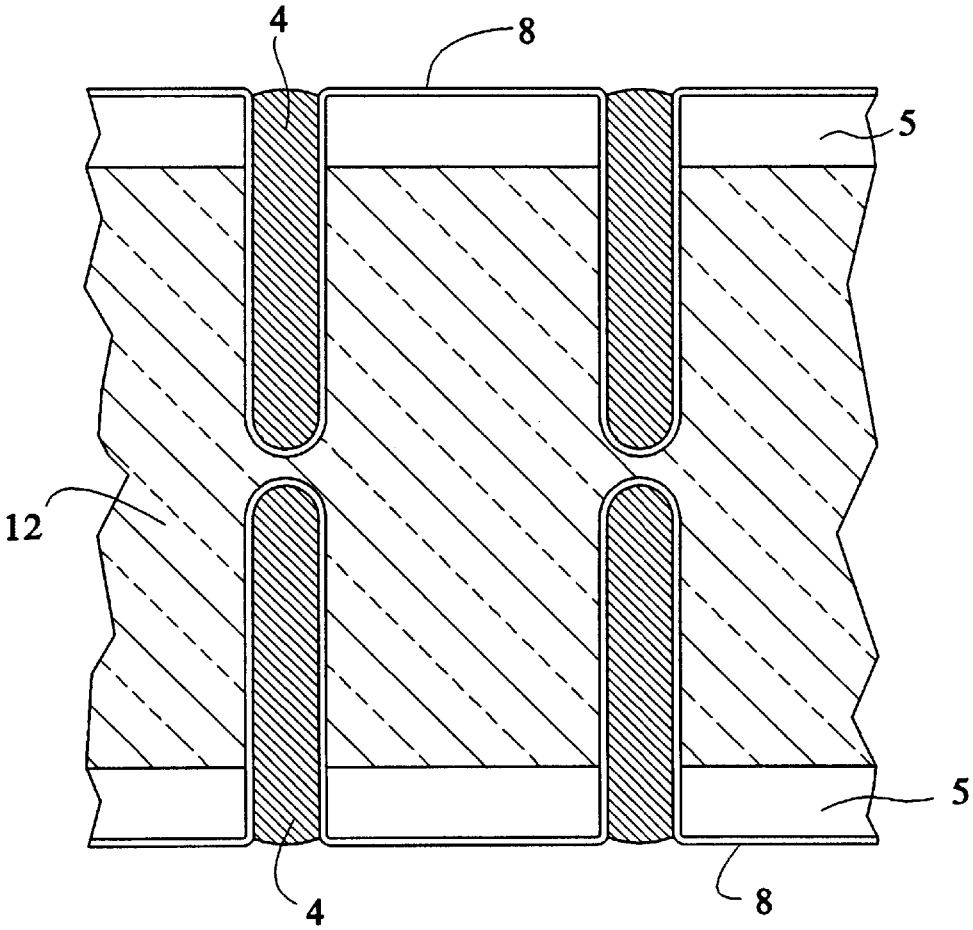
FIG. 5

FORM MASK ON SILICON CARRIER BLOCK
19
ETCH THROUGH MASK
20
REMOVE MASK
21
23
FORM OXIDE OR NITRIDE LAYER
22
INTRODUCE ABSORPTION MATERIAL
24
REMOVE EXCESS ABSORPTION MATERIAL
25
ETCH BACK OF SILICON CARRIER BLOCK
26
ANGLING OF THE ABSORPTION ELEMENTS
27
FILL WITH TRANSPARENT MATERIAL
28
COMBINE TWO FINISHED CARRIERS

STRAY RADIATION GRID

BACKGROUND OF THE INVENTION

1. Field of the Invention

The present invention relates to a stray radiation grid, particularly for use in a medical x-ray apparatus, and to a method for producing such a grid, the grid being of the type having a carrier material with penetrating radiation absorption elements, particularly lead elements disposed in spaced, substantially parallel rows, the carrier material being silicon provided with holes, and wherein the absorption elements being arranged in the holes.

2. Description of the Prior Art

Stray radiation grids are utilized as collimators in x-ray diagnosis in order to suppress stray radiation. Known grids have a paper carrier into which absorption elements are introduced in the form of lead lamellae with a thickness of several micrometers. These grids create unavoidable lines on the x-ray image. Moreover, the number of lines per cm is limited for reasons of production technology.

U.S. Pat. No. 5,418,833 teaches a stray radiation grid of the initially-described type. This grid has a carrier material of silicon into which openings are etched in the form of channels and the like, which are subsequently filled with absorption material. This grid is relatively rigid and immobile, however, so that a focusing of this grid is expensive and difficult. Furthermore, the transmission properties are poor as a consequence of the grid thickness.

SUMMARY OF THE INVENTION

An object of the present invention is to provide a radiation grid which is improved with respect to known grids with respect to handling and processability, as well as in its transmission behavior.

This object is inventively achieved in a stray radiation grid for penetrating radiation having a silicon carrier with hoes therein in which absorption elements are respectively disposed, wherein the thickness of the silicon carrier is less than the length of the absorption elements, at least in regions of the grid.

The inventive stray radiation departs from the known paper carrier and instead utilizes a crystalline carrier material, namely silicon. The holes are introduced into the silicon carrier as recesses or bores. A particular advantage of the use of silicon is that this material can be etched in an extremely simple fashion; i.e. the holes can be added in the framework of an etching step, e.g. plasma etching or electrochemical etching. Since the holes can be added in a random arrangement and spacing from each other, as is known from semiconductor technology a particular advantage of the inventive grid is that the number of lines per cm can be increased to considerable values with no effort, so imaging-related degradations of the x-ray image are no longer of concern. The penetrating radiation absorption material, for example lead, is introduced into the holes, so that in combination with the transmission properties of the silicon, an extremely effective stray radiation grid is achieved.

The thickness of the silicon is inventively smaller than the length of the absorption elements, at least in subregions of the grid; i.e. the grid is thinned within the transmitting silicon region, so that the absorption elements project free on one side of the carrier. This results in the achievement of an extremely thin foil which can be handled and processed in simple fashion, e.g. it can be applied subsequently on a mechanically supporting, further carrier. The transmission behavior is also considerably improved, since, as a consequence of the significantly reduced silicon thickness, the transmission losses in the silicon are decreased. The thickness of the silicon is reduced particularly appropriately by an etching process, wherein known etching techniques can be used.

The holes can inventively have an essentially annular cross section (in a plane parallel to the carrier surface), as well as an essentially oblong shape (in a plane perpendicular to the carrier surface); i.e. not only is the formation of successive hole rows possible, but also e.g. the formation of channels or grooves or complete oblong holes. Each row of holes can be composed of holes which are arranged in an alternatingly staggered fashion relative to one another, since the total width of such a row of holes can be sufficiently varied, given a correspondingly small separation of the holes and corresponding displacement.

It has proven to be particularly appropriate to arrange a further layer at least in the region between the silicon and the absorption elements, which is advantageous particularly for reasons of stability. The layer can be a silicon oxide layer or a silicon nitride layer; either of these layers can be applied with oxidation or deposition methods known from semiconductor technology, such as CVD methods, etc. This further layer, i.e., the oxide layer or the nitride layer, should surround the absorption elements which are basically free-standing. This is advantageous, since given an oxide layer or nitride layer which extends along the entirety of the sidewall of the hole, this layer forms an etching stop layer with respect to the silicon etching for thinning the silicon.

To increase the stability of the inventive grid, a material that is preferably highly transparent for the transmitting radiation can be arranged in the thinned regions of the silicon. This material can be a plastic, a glue or a foam.

Above all, to be able to protect the free-standing absorption element regions arising by etching away the silicon, it has proven to be appropriate to dispose two such silicon carriers opposite each other, with their respective absorption elements projecting toward one another, these two carriers being subsequently connected in a positionally stable fashion by means of a holding medium, particularly a glue, so that the free-standing elements face each other and are embedded in the interior. The silicon carriers can be arranged with respect to one another such that the irrespective absorption elements are in registration i.e., so that the active absorption length is approximately doubled. Instead the respective absorption elements can be arranged staggered relative to one another, so that the line count per cm is increased even further. The silicon carriers which are mutually connected in this way can be carriers which have been mechanically stabilized, or which have not been stabilized, or which are stabilized and filled with material.

As the silicon carrier, monocrystalline silicon wafers are preferably utilized which can be drawn already with diameters of 30 cm and greater. Such a grid size is particularly adequate for utilization in the framework of mammography. In order to be able to produce arbitrarily large grids independent of the wafer size, in a further embodiment of the invention the grid can be formed by a number of adjacently arranged, preferably rectangular, silicon carrier elements with absorption elements; i.e. the grid is composed in a segmented or titled fashion from a number of parts. Two carrier elements can be respectively set at an angle to each other such that the grid proceeds essentially at a slant cross-sectionally, so that a focusing in the direction of the radiation source is thus achieved. Alternatively, the carrier segments can be adjacently arranged to form one plane. In this case the absorption elements of two adjacent segments respectively proceed at different angles with respect to each other; i.e. the absorption elements, e.g. in the form of lead strands or threads, reside at a defined angle with respect to the segment surface, e.g. between 90° and 70°, this angle continuously increasing from segment to segment proceeding from the center line of the grid, so that the focusing can also be achieved in this manner also.

For improving the stability the grid, as is known for paper grids, can be placed on , particularly glued on, at least one carrier, particularly a CFK plate. For the purpose of focusing this carrier can be bent or curved in cross-section.

The thickness of the silicon carrier is inventively selected between 0.5 mm and 1.5 mm, particularly about 0.72 mm, with the thickness in the thinned region being smaller than 0.75 mm, particularly smaller than 0.5 mm. This thickness is adequate in the field of mammography, where processing occurs with low-energy radiation, anyway. Of course, these suggested values only represent nominal values which can be exceeded or not reached in respective applications. The diameter of the holes can inventively lie in the range between 1 $\mu$m and 50 $\mu$m, particularly between 6 $\mu$m and 20 $\mu$m, dependent on the shaft ratio and the line count per cm for a particular application.

The invention also relates to a method for producing a stray radiation grid or for producing segments suitable for utilization in a stray radiation grid. In the inventive method a directionally-selective etching process is employed to form holes in a carrier of silicon, with absorption material subsequently being introduced into the holes, and to reduce the thickness, silicon is removed at one side of the carrier in an etching process following the creation of the absorption elements. As previously explained, etching processes known in semiconductor technology can be utilized. An electrochemical etching process as described in German OS 42 02 454, for example, has proven to be particularly appropriate.

To develop the etching structure prior to the etching, a lithographic etching mask, particularly a photo-lithographic etching mask, corresponding to the hole pattern to be created is placed on the surface which is to be etched. This mask is removed following the etching. Known masking methods can be used, which need not be further discussed. The absorption material is subsequently introduced into the holes in liquid or viscous state, where it cools. Excess absorption material is subsequently removed. This can also occur by means of an etching step, whereby the etching liquid is selected, if wet chemical etching is employed, or the etching parameters are selected, such that the absorption material is selectively etched, but not the silicon. The introduction of the absorption material appropriately occurs with a pressure force prevailing at the introduction-side of the silicon carrier. This pressurization should be about 2 bars but upward or downward deviations therefrom are possible. As introduction techniques, casting methods or electrochemical depositing methods can be utilized, for example.

As already mentioned, it is appropriate for reasons of stability and after-treatment to provide another layer, appropriately a silicon oxide or silicon nitride layer. This is inventively applied after the etching and prior to the introduction of the absorption material, so that it at least lines the holes, but also it may cover the unetched surfaces free of the photosensitive resist, or the like. The etching material can be subsequently introduced. As the next step, in order to thin the silicon, an etching step can be performed for thinning the silicon carrier layer, this removal of material being selective relative to the created oxide layer or nitride layer (or to the absorption elements if there is no additional layer). In this way, a foil is produced which is particularly appropriate because it is optimally flexible and offers a wide spectrum of applications. It is additionally possible to place a material which is preferably highly transparent for the transmitting radiation onto the etched side, as already described. Additionally or independently of whether such material is introduced, two silicon carriers can be arranged in opposition, justified, and subsequently connected to each other by means of a holding medium, particularly a glue, in order to form the multilayer grid.

Monocrystalline (100)-silicon wafers are inventively utilized as the silicon carrier. The hole formation then takes place along the preferred (100) direction in the framework of the etching. In addition, for the production of the segments silicon wafers can be utilized whose respective (100)-direction runs at an angle, articularly an angle between 0° and 10° relative to the wafer surface, from which the segments are produced with absorption elements in place. Following completion the segments can be sawed out of the silicon wafer, but the segments can just as well be sawed out prior to the introduction of the absorption material.

DESCRIPTION OF THE DRAWINGS

FIG. 4 is a sectional view of a portion of a stray radiation grid in accordance with the invention in a completed stage, with (left side) mechanical stabilization and without (right side) mechanical stabilization.

FIG. 5 is a sectional view through a portion of a stray radiation grid in accordance with the invention, in a further embodiment wherein two grids as shown in FIG. 4 have been combined.

DESCRIPTION OF THE PREFERRED EMBODIMENTS

Figure 1:
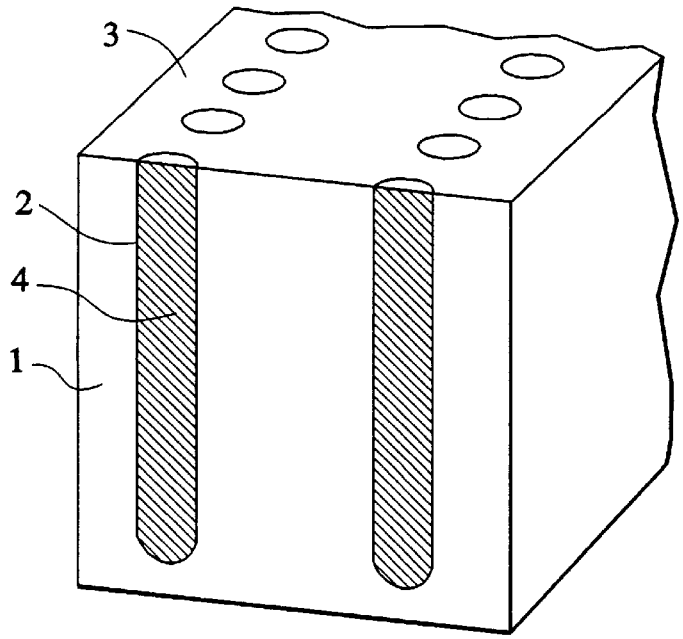
FIG. 1 is a sectional view of a portion of a stray radiation grid in accordance with the invention, in an intermediate stage of production according to the inventive method.

FIG. 1 shows a section of a portion of an inventive stray radiation grid in an intermediate stage of production. The grid in this partially completed stage is in the form of a silicon carrier block 1, such as a monocrystalline (100)-silicon wafer. The silicon carrier block 1 has a number of holes 2 respectively forming separate rows. These holes have been etched into the silicon carrier block 1 by means of a directionally selective etching process. An electrochemical etching process an anisotropic etching process, an ion etching process as well as a plasma etching process are particularly suited for this. The dimension of the holes 2 was defined by a photomask placed on the surface 3 of the silicon carrier block 1, as was their arrangement. Any mask known from semiconductor technology can be utilized for the photomask. Following development of the holes 2, these are filled with radiation absorbing material, preferably lead, to form the absorption elements 4, for which likewise several techniques can be used. The lead can be electrochemically deposited in the holes. Alternatively, the introduction of liquid lead by means of a casting process is possible, whereby this can proceed, for example, by covering the surface 3 of the silicon carrier block 1, with a wetting inhibitor, so that the liquid lead does not adhere thereto with the holes 2 acting in the manner of capillaries, so that the lead immediately flows off following the removal of the silicon carrier block 1 from the molten mass of lead. Alternatively, the lead can be repolished on the surface 3 following cooling.

Figure 2:
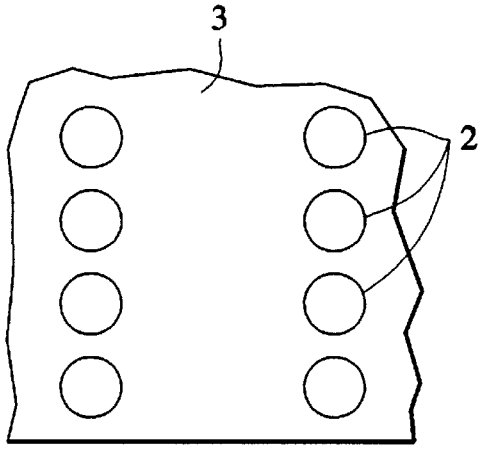
FIG. 2 is a plan view of the stray radiation grid of FIG. 1, showing a first embodiment for arranging the absorption elements.

As shown in FIG. 2, the holes are arranged spaced in close succession for row formation. The hole diameter lies in the micrometer range, as does the row separation. The respective geometric dimensions are selected according to the desired shaft ratio as well as the desired line count per cm. Dependent on the etching and introduction techniques, the holes can be added in approximately random separation from one another. This enables the achievement of an extremely high number of lines per cm, unlike in known stray radiation grids. It is possible without further difficulty to realize a line count of 625 per cm given a hole diameter of 6 $\mu$m, a successive hole separation of 6 $\mu$m, a separation from row to row of about 17 $\mu$m, and a hole depth of about 300 $\mu$m given a shaft ratio of 18, for example.

Figure 3:
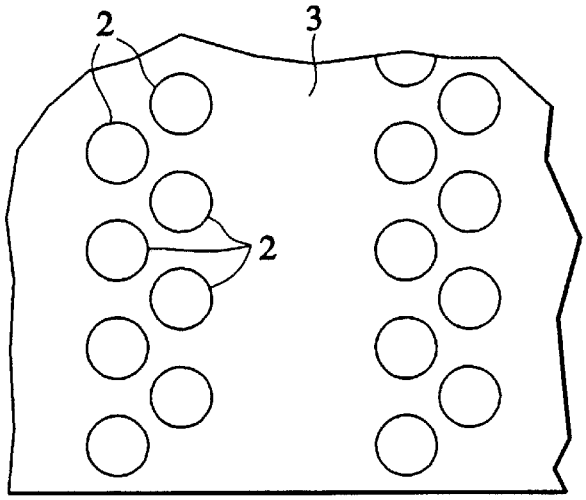
FIG. 3 is a plan view of a portion of a further embodiment of a stray radiation grid according to the invention, showing a different arrangement of the absorption elements.

FIG. 3 depicts another form of the development of the holes 2. Each row of holes 2—which are arranged in an alternatingly staggered fashion relative to one another—is formed so that the total width of the respective row can be ultimately varied within considerable limits—conditioned by the extremely close succession of the holes 2—without having to etch extremely large holes .

FIG. 4 shows a section through a portion of the grid following further production steps some of which are optional. Following the production of the holes 6, a layer 8 can be deposited on the surface 3 of the carrier block 1 (see FIG. 1), the layer 8 being a silicon oxide layer or silicon nitride layer. This layer 8 also lines the holes 6 within the silicon carrier block 1. Following deposition of the layer 8, the absorption elements 4 are introduced into the carrier block 1. The silicon carrier block 1 is subsequently re-etched from the opposite side, so that a thinned carrier 5 is formed from which the absorption elements 4 project free-standing, as shown at the right side of FIG. 4, surrounded solely by the layer 8. This layer 8 serves for stabilization as well as acting as an etching barrier; i.e., it is not affected during the etching process, wherein the silicon is selectively etched. In this way it is possible to thin the silicon carrier block 1 to a significant extent, so that the resulting carrier 5 is extremely flexible and movable in the manner of a foil; i.e., the entire stray radiation grid can be bent and handled in the manner of a foil. A further advantage is that the silicon layer (i.e., the thickness of the carrier 5) permeated by the transmitted penetrating radiation is very thin, so that the transmission losses are extremely low.

As FIG. 4 further shows on the left, the etched side can be filled with a material 10 which is preferably highly transparent for the transmitting radiation, preferably a plastic, which is advantageous for protective purposes for the extremely thin absorption element threads forming the absorption elements 4.

FIG. 5 shows a further embodiment of the inventive stray radiation grid which is formed by two stray radiation grids as described above, arranged in mutual opposition. The two thinned silicon carriers 5 are connected with each other by means of an organic glue 12 in a positionally exact fashion after the two carriers 5 have been oriented with reference to each other so that the absorption elements 29 are arranged immediately above one another. Alternatively, a staggered arrangement can be employed. In this embodiment, the glue 12 permeates all the interspaces and leads to a sufficiently secure connection.

Figure 6:
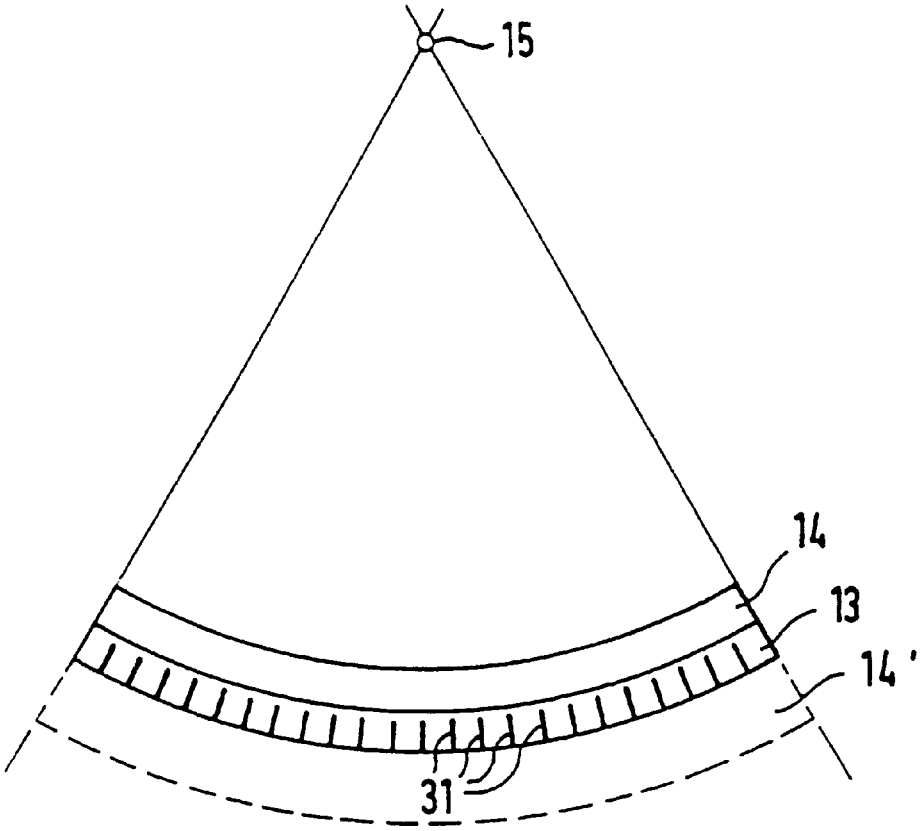
FIG. 6 is a schematic illustration of a portion of a medical examination apparatus with a grid in accordance with the invention placed on a carrier for focusing, in a curved embodiment.

FIG. 6 shows a stray radiation grid 13 which is glued to a carrier 14, e.g. a CFK plate. The upper side of the silicon carrier S is glued therein directly onto the lower side of the carrier 14 by a bonding agent. The carrier 14 is easily bent, and as a result the bonded stray radiation grid can proceed in a slightly curved shape. As shown in FIG. 6, the absorption elements 4 remain in their perpendicular position with respect to the silicon surface. The curved shape is selected such that the absorption elements 4 are focused with reference to the radiation source 15.

Figure 7:
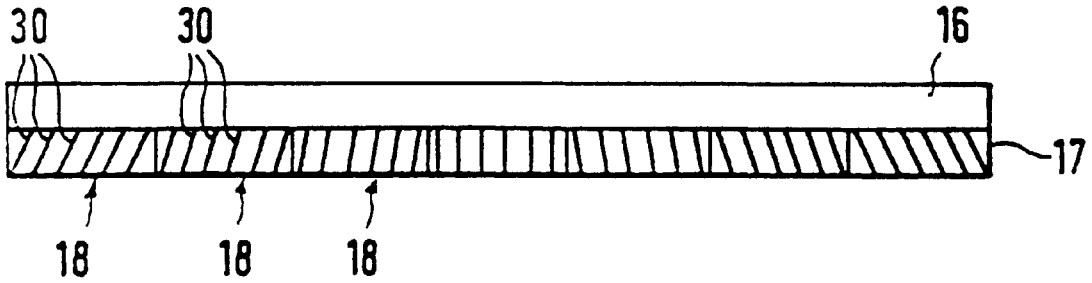
FIG. 7 is a sectional view of a grid in accordance with the invention placed on a planar carrier, with the absorption elements arranged for focusing the radiation.

A further embodiment of a stray radiation grid 17 placed on a carrier 16 is shown in FIG. 7. This stray radiation grid 17 is formed by a number of individual grid segments 18. The grid segments 18 are produced according to the inventive method. The grid segments 18 are adjacently arranged in immediate succession. As FIG. 7 depicts, the absorption elements 30 of the respective grid segments 18 proceed respectively at various angles with respect to the carrier surface. That is, proceeding from the center grid segment 18, the absorption elements are increasingly angled with increasing proximity to the grid margin, whereby a sufficient focusing is achieved. If the grid segments 18 are formed of monocrystalline silicon wafers in which the (100)-direction (plane) proceeds at a slight angle with respect to the carrier surface, in the directionally selective etching the holes also will be produced with an angled corresponding to the (100)-direction. A similar effect could also be achieved in a "one-piece" stray radiation grid, producing the holes for the absorption elements 4 at directions deviating from the direction perpendicular to the carrier surface with increasing proximity to the grid margin, so that a focusing can be achieved. In this case the stray radiation grid would form one plane; i.e., the grid itself is not bent for focusing.

Figure 8:
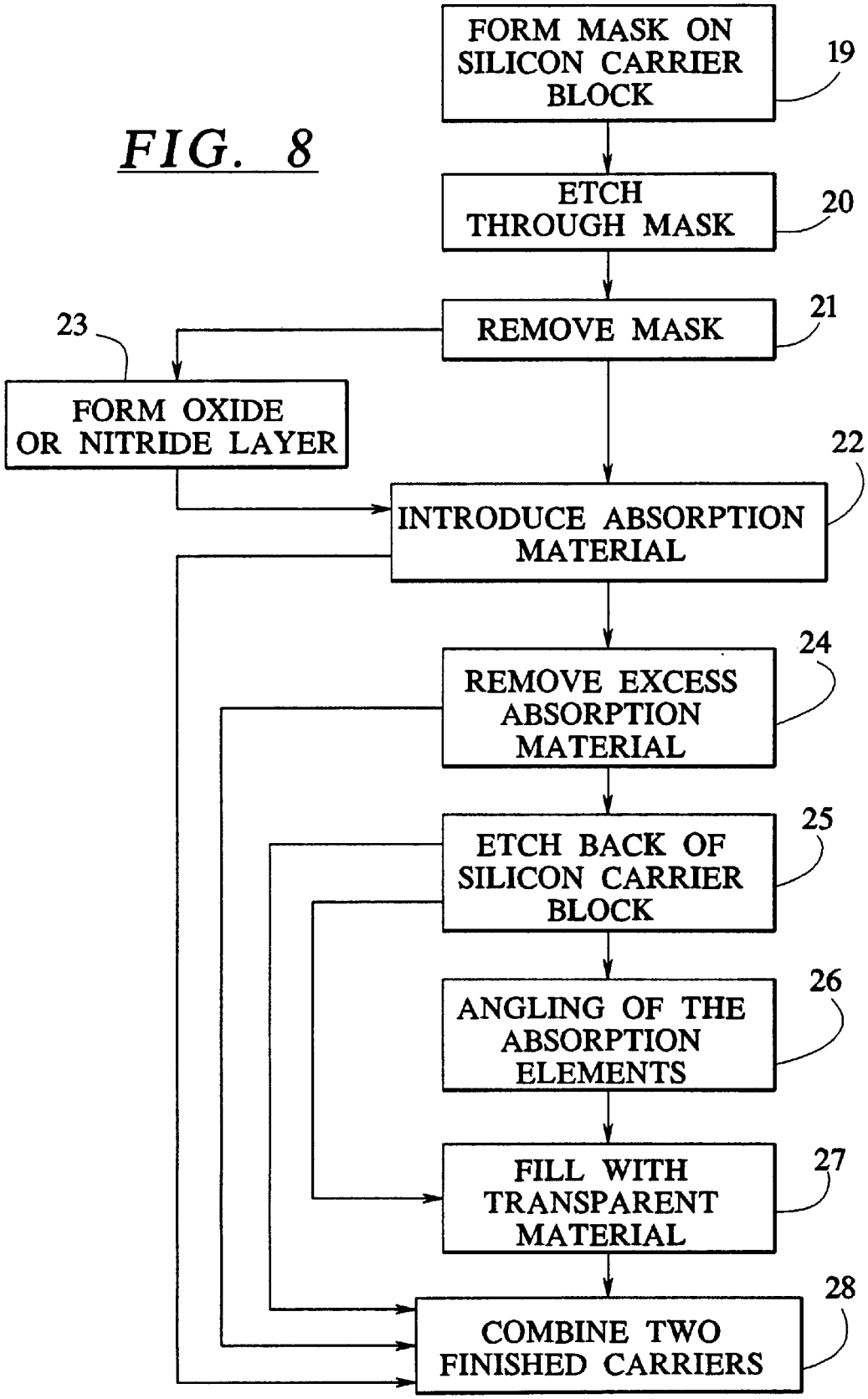
FIG. 8 is a flow chart showing the basic steps of the invention in accordance with the invention for making a stray radiation grid in accordance with the invention.

FIG. 8 depicts a sequential diagram related to the production method and variation thereof for the inventive stray radiation grid. Accordingly, the etching mask is developed on the silicon carrier in a first step 19, after which the etching step 20 follows. The etching mask is subsequently removed again in step 21. Subsequently there are two production alternatives. According to a first alternative, the absorption material is introduced in step 22 immediately following the removal of the mask. Alternatively, the oxide layer or nitride layer can be deposited earlier in step 23, at least in the region of the holes, after which step 22 follows, i.e. the introduction of the absorption material. If excess absorption material is not immediately removed from the silicon carrier surface in step 22, this is done in step 24. The removal can occur by burnishing or re-etching or the like. The further etching step of the silicon carrier follows in step 25 in order to free the absorption elements on one side of the carrier. After any cleaning which may be needed, a finished grid exists (which can be mechanically stabilized, and/or joined with another grid, in further optional steps). If, however, in step 26 the aforementioned angling of the absorption elements for focusing purposes is undertaken, the absorption elements are subsequently embedded in transparent material in step 27. If the bending according to step 26 is unnecessary, the transparent material can be introduced immediately following step 25. Following each of the steps 26 and 27, a finished grid exists that can be further processed. If desired, in step 28 the connection of two silicon carriers can occur. All the stray radiation grids obtained according to the steps 22 to 27 can be connected. This multilayer grid can also then be connected with a carrier to the extent necessary.

Although modifications and changes may be suggested by those skilled in the art, it is the intention of the inventors to embody within the patent warranted hereon all changes and modifications as reasonably and properly come within the scope of their contribution to the art.

We claim as our invention:

1. A stray radiation grid for penetrating radiation comprising:

a carrier comprised of silicon and having a plurality of holes extending through said carrier, said holes being arranged in said carrier in a plurality of spaced, substantially parallel rows, said carrier having a carrier thickness;

a plurality of penetrating radiation absorption elements respectively disposed in and extending through said holes, each of said absorption elements having an absorption element thickness; and at least in a region of said carrier, said carrier thickness being smaller than said absorption element thickness so that said absorption elements, in said region, project free-standing from said carrier.

2. A stray radiation grid as claimed in claim 1 wherein said carrier comprises a carrier having a plurality of said holes each having an annular cross-section.

3. A stray radiation grid as claimed in claim 1 wherein said carrier comprises a carrier having holes therein arranged in said rows wherein each of said rows is formed by holes disposed in an alternatingly staggered arrangement relative to each other.

4. A stray radiation grid as claimed in claim 1 wherein said carrier comprises a carrier having said holes formed therein by etching.

5. A stray radiation grid as claimed in claim 1 further comprising a layer surrounding each of said absorption elements and disposed at least between each of said absorption elements and said carrier.

6. A stray radiation grid as claimed in claim 5 wherein said carrier has a carrier surface opposite a side of said carrier from which said radiation absorption elements project free-standing, and wherein said layer completely surrounds each of said absorption elements, except at said carrier surface.

7. A stray radiation grid as claimed in claim 5 wherein said layer comprises a material selected from the group consisting of silicon oxide and silicon nitride.

8. A stray radiation grid as claimed in claim 1 wherein said carrier comprises a carrier wherein said carrier thickness is produced by etching away silicon from a carrier block comprised of silicon having a carrier block thickness larger than said carrier thickness.

9. A stray radiation grid as claimed in claim 1 further comprising material adjacent to said carrier and at least partially surrounding said absorption elements which is substantially transparent to said penetrating radiation.

10. A stray radiation grid as claimed in claim 9 wherein said material is selected from the group consisting of plastic, glue and foam.

11. A stray radiation grid as claimed in claim 1 wherein said carrier and said plurality of absorption elements comprise a first grid arrangement, and said stray radiation grid additionally comprising a second grid arrangement, identical to said first grid arrangement, said first grid arrangement and said second arrangement being disposed with the respective pluralities of absorption elements therein facing each other in a space between the respective carriers of said first grid arrangement and said second grid arrangement, and wherein said space is filled with a holding medium.

12. A stray radiation grid as claimed in claim 11 wherein said first grid arrangement and said second grid arrangement are disposed relative to each other with the respective pluralities of absorption elements in registration with each other.

13. A stray radiation grid as claimed in claim 11 wherein said first grid arrangement and said second grid arrangement are disposed relative to each other with the respective pluralities of absorption elements disposed staggered relative to each other.

14. A stray radiation grid as claimed in claim 11 wherein said holding medium comprises glue.

15. A stray radiation grid as claimed in claim 1 wherein said carrier comprises a rectangular carrier and wherein said rectangular carrier with said plurality of absorption elements comprise a rectangular grid element, and wherein said stray radiation grid comprises a plurality of further rectangular grid elements, substantially identical to said rectangular grid element, disposed adjacent to each other in a tile-like combination.

16. A stray radiation grid as claimed in claim 15 wherein at least two of said rectangular grid elements are disposed at an angle relative to each other so that the respective absorption elements in said at least two grid elements are disposed at a diverging angle relative to each other.

17. A stray radiation grid as claimed in claim 15 wherein said grid elements are disposed in a single plane, and wherein at least two of said grid elements which are adjacent to each other have respective absorption elements which are disposed at a diverging angle relative to each other.

18. A stray radiation grid as claimed in claim 1 wherein said carrier has a carrier surface adapted to receive penetrating radiation, said carrier surface being curved so that said absorption elements are not parallel to each other.

19. A stray radiation grid as claimed in claim 1 further comprising a mechanically stabilizing element attached to said carrier.

20. A stray radiation grid as claimed in claim 19 wherein said mechanically stabilizing element is glued to said carrier.

21. A stray radiation grid as claimed in claim 19 wherein said mechanically stabilizing element comprises a CFK plate.

22. A stray radiation grid as claimed in claim 1 wherein said stray radiation grid has a curved cross-section in a plane proceeding through a row in said plurality of rows.

23. A stray radiation grid as claimed in claim 1 wherein said carrier comprises at least a portion of a monocrystalline silicon wafer.

24. A stray radiation grid as claimed in claim 1 wherein said carrier thickness is in a range between 0.5 mm and 1.5 mm.

25. A stray radiation grid as claimed in claim 24 wherein said carrier thickness is approximately 0.72 mm.

26. A stray radiation grid as claimed in claim 1 wherein each of said holes in said carrier has a diameter in a range between 1 $\mu$m and 50 $\mu$m.

27. A stray radiation grid as claimed in claim 26 wherein each of said holes in said carrier has a diameter in a range between 6 $\mu$m and 20 $\mu$m.

28. A method for making a scattered ray grid for penetrating radiation, comprising the steps of:

(a) providing a carrier block of silicon having a first surface and a second surface opposite said first surface, and having a carrier block thickness between said first and second surfaces;

(b) directionally selectively etching said carrier block from said first surface to produce a plurality of holes in said carrier block proceeding from said first surface;

(c) filling each of said holes with penetrating radiation absorbing material; and (d) selectively etching said carrier block from said second surface to produce a carrier having a carrier thickness which is less than said carrier block thickness, and from which said absorbing material projects as a plurality of free-standing absorption elements.

29. A method as claimed in claim 28 wherein step (b) comprises the steps of:

placing a lithographic etching mask having hole pattern therein on said first surface prior to etching from said first surface; and removing said lithographic etching mask after etching from said first surface.

30. A method as claimed in claim 28 wherein the etching in at least one of steps (b) and (d) comprises electrochemical etching.

31. A method as claimed in claim 28 wherein the etching in at least one of steps (b) and (d) comprises plasma etching.

32. A method as claimed in claim 28 wherein step (c) comprises introducing said penetrating radiation absorbing material into said holes by electrochemical deposition.

33. A method as claimed in claim 28 wherein step (c) comprises the steps of:

introducing said penetrating radiation absorbing material into said holes in a flowable state;

subsequently cooling said penetrating radiation absorbing material in said holes in said carrier block; and removing any excess penetrating radiation absorbing material.

34. A method as claimed in claim 28 wherein step (c) comprises the steps of:

applying a wetting inhibitor to any portions of said carrier block which are not to be covered by said penetrating radiation absorbing material;

introducing said penetrating radiation absorbing material into said holes in a flowable state; and cooling said penetrating radiation absorbing material in said holes in said carrier block.

35. A method as claimed in claim 28 wherein step (c) comprises introducing said penetrating radiation absorbing material into said holes in a flowable state while producing a pressure at said first surface of said carrier in a range between 1 to 10 bars.

36. A method as claimed in claim 28 comprising the additional step, between steps (b) and (c), of lining said holes in said carrier with a layer so that, after selectively etching said carrier block in step (d), each of said free-standing absorption elements is surrounded by said layer.

37. A method as claimed in claim 36 comprising the additional step of extending said layer to cover said first surface except over said holes.

38. A method as claimed in claim 36 comprising the additional step of selecting material for said layer from the group consisting of silicon oxide and silicon nitride.

39. A method as claimed in claim 36 wherein step (d) comprises selectively etching said carrier block from said second surface with an etchant which is selective with respect to said layer.

40. A method as claimed in claim 28 wherein step (d) comprises selectively etching said carrier block from said second surface using an etchant which is selective with respect to said penetrating radiation absorbing material.

41. A method as claimed in claim 28 wherein step (d) comprises selectively etching said carrier block from said second surface to remove between 0.5 mm and 0.75 mm of silicon, leaving said carrier having said carrier thickness between 0.5 mm and 1.5 mm.

42. A method as claimed in claim 41 comprising leaving said carrier with said carrier thickness of approximately 0.72 mm.

43. A method as claimed in claim 28 wherein said free-standing absorption elements are upon completion of step (d) substantially parallel to each other, and comprising the additional step of bending said carrier to orient said absorption elements at respective diverging angles relative to each other.

44. A method as claimed in claim 28 comprising the additional step after step (d) of at least partially surrounding said free-standing absorption elements with material transparent to said penetrating radiation.

45. A method as claimed in claim 44 comprising the additional step of selecting said material from the group consisting of curable plastic, glue and foam.

46. A method as claimed in claim 28 comprising duplicating steps (a), (b), (c) and (d) to produce a further carrier, substantially identical to said carrier, having a further plurality of free-standing absorption elements identical to said plurality of free-standing absorption elements, and comprising the additional steps of:

orienting said carrier and said further carrier with said plurality of free-standing absorption elements and said further plurality of free-standing absorption elements facing each other with a spacing between said carrier and said further carrier; and filling said spacing with a holding medium.

47. A method as claimed in claim 46 wherein the step of orienting said carrier and said further carrier comprises orienting said carrier and said further carrier with said plurality of free-standing absorption elements in registration with said further plurality of free-standing absorption elements.

48. A method as claimed in claim 46 wherein the step of orienting said carrier and said further carrier comprises orienting said carrier and said further carrier with said plurality of free-standing absorption elements being staggered relative to said further plurality of free-standing absorption elements.

49. A method as claimed in claim 28 wherein step (a) comprising providing a single crystal of (100) silicon and producing a plurality of wafers from said single crystal silicon, and performing steps (a), (b), (c) and (d) on each of said wafers as said carrier block of silicon.

50. A method as claimed in claim 49 wherein each of said wafers has a (100) direction disposed at an angle relative to a planar surface of the wafer, said angle being between 0° and 10°.

51. A method as claimed in claim 49 wherein the step of producing said wafers comprises sawing said wafers from said single crystal silicon.

52. A method as claimed in claim 28 wherein the etching in at least one of steps (b) and (d) comprises anisotropic etching.

53. A method as claimed in claim 28 wherein the etching in at least one of steps (b) and (d) comprises dry etching.

54. A method as claimed in claim 28 wherein the etching in at least one of steps (b) and (d) comprises ion etching.

* * * * *